US010125934B1

(12) United States Patent
Zhang

(10) Patent No.: US 10,125,934 B1
(45) Date of Patent: Nov. 13, 2018

(54) T-GRID LED LIGHTING SYSTEM WITH INSERTEDLY COUPLED ILLUMINATION ASSEMBLY

(71) Applicant: Shenzhen OKT Lighting Co., Ltd., Shenzhen (CN)

(72) Inventor: Allan Zhang, Shenzhen (CN)

(73) Assignee: Shenzhen OKT Lighting Co., Ltd., Shenzhen (CN)

( * ) Notice: Subject to any disclaimer, the term of this patent is extended or adjusted under 35 U.S.C. 154(b) by 0 days.

(21) Appl. No.: 15/927,276

(22) Filed: Mar. 21, 2018

(51) Int. Cl.

| | |
|---|---|
| ***F21S 4/28*** | (2016.01) |
| ***F21V 5/04*** | (2006.01) |
| ***F21V 23/00*** | (2015.01) |
| ***F21V 29/70*** | (2015.01) |
| ***F21V 29/89*** | (2015.01) |
| ***F21S 8/04*** | (2006.01) |
| ***F21V 15/015*** | (2006.01) |
| ***F21V 21/005*** | (2006.01) |
| *F21Y 103/10* | (2016.01) |
| *F21Y 115/10* | (2016.01) |

(52) U.S. Cl.
CPC ..... *F21S 8/043* (2013.01); *F21S 4/28* (2016.01); *F21V 5/04* (2013.01); *F21V 15/015* (2013.01); *F21V 21/005* (2013.01); *F21V 23/008* (2013.01); *F21V 29/70* (2015.01); *F21V 29/89* (2015.01); *F21Y 2103/10* (2016.08); *F21Y 2115/10* (2016.08)

(58) Field of Classification Search
CPC .... F21S 8/043; F21S 4/28; F21V 5/04; F21V 15/015; F21V 29/70; F21V 29/89; F21V 21/005; F21V 23/008
See application file for complete search history.

(56) References Cited

U.S. PATENT DOCUMENTS

| | | | | |
|---|---|---|---|---|
| 8,177,385 | B2 | 5/2012 | Porciatti | |
| 9,879,850 | B2 | 1/2018 | Porciatti | |
| 2003/0081419 | A1* | 5/2003 | Jacob | F21S 8/04 362/364 |
| 2011/0103043 | A1* | 5/2011 | Ago | F21S 8/04 362/147 |
| 2016/0076746 | A1* | 3/2016 | Porciatti | F21V 29/76 362/404 |

* cited by examiner

*Primary Examiner* — Thomas M Sember
(74) *Attorney, Agent, or Firm* — Jingjing Ye; Culhane Meadow, PLLC

(57) ABSTRACT

The present invention discloses a T-Grid LED lighting system with insertedly coupled illumination assembly, including a T-Bar, an illumination assembly, and a driver assembly. The illumination assembly includes parts that are insertedly coupled to each other and to the T-Bar, providing convenience and saving cost in maintenance and/or update. The T-Grid LED lighting system also generates less heat and has advantageous thermal dissipation, eliminating the need for extra heat dissipation structures.

19 Claims, 5 Drawing Sheets

T-GRID LED LIGHTING SYSTEM WITH INSERTEDLY COUPLED ILLUMINATION ASSEMBLY

TECHNICAL FIELD

The present invention relates to a T-Grid LED lighting system. More specifically, the present invention relates to a T-Grid LED lighting system for suspended ceilings that is convenient to maintain and update.

BACKGROUND OF THE INVENTION

Light-emitting diodes (LEDs) is a type of semiconductor device that emits visible lights. As a new type of light source, LEDs have many advantages over conventional lighting methods. For example, comparing to convention lightings such as incandescent and fluorescent lightings, the life span of LED lightings is much longer and the energy consumption in terms of lumens per watt is much lower. LEDs are small in size and have very fast response time to control signals, paving the way for many new applications inconceivable with conventional lightings. The manufacturing process of the LED also costs less and is much more environmentally friendly. Due to the many advantages of the LED lightings, they are rapidly replacing conventional lightings, becoming the preferred choice for many lighting applications.

In commercial and residential buildings, T-Grid ceilings, or suspended ceilings, are commonly used. T-Grid ceilings are usually attached to the structural ceiling of the building and provide resting places for ceiling tiles to form a lowered "false ceiling". With the advent of the increasing popularity of the LED lightings, they are also incorporated in T-Grid ceiling applications. One way of incorporating the LED lightings with the T-Grid ceiling is to place the illuminating part of the LED lightings between the ceiling tiles and hide the control part and wire connections above the ceiling tiles such that they are not visible.

However, the conventional T-Grid ceiling with LED lightings have design disadvantages in many regards. For example, in Porciatti, U.S. Pat. No. 8,177,385, incorporated herein by reference, in order to the dissipate heat generated by the LED light, the design has to include fins for the purpose of heat dissipation that make the appearance of the design more complicated and bulky. For another example, the prior art T-Grid LED lightings use lenses that are integrated to the rest of the lightings, making it inconvenient and costly to change or update the lights. Also, the conventional LED lighting fixtures terminate the end of the lightings with parts that are non-illuminative, that cannot achieve continued lighting effect demanded by modern designers.

As such, there is a need to provide a T-Grid LED lighting with insertedly coupled illumination assembly that overcomes the above disadvantages of the prior art.

SUMMARY OF THE INVENTION

An object of the present invention is to provide a T-bar LED lighting system with insertedly coupled parts that are easy to maintain and update.

Another object of the present invention is to provide an LED lighting system driven by low voltage power, thereby reducing heat generation.

Another object of the present invention is to provide an advantageous thermal dissipation design of the LED lighting system, eliminating the need for extra heat dissipation structures.

Another object of the present invention is to provide an LED lighting system supporting interchangeable lens and LED lighting modules that can be conveniently updated and replaced according to the present application and user preference.

Another object of the present invention is to an LED lighting system where a plurality of the lightings may share one driver.

Another object of the present invention is to provide a flush mount of the LED lightings to the ceiling tiles, providing an appealing visual effect.

Another object of the present invention is to provide LED lightings that have continuous and uninterrupted illumination through the lens and at the terminal ends.

Another object of the present invention is to provide a T-Grid LED lighting system with insertedly coupled illumination assembly, including: a T-Bar configured to be incorporated into a T-Grid ceiling system; an illumination assembly, including: a bottom plate; n LED lighting module insertedly coupled to the bottom plate; and a lens insertedly coupled to the bottom plate; wherein the illumination assembly is insertedly coupled to the T-Bar via the bottom plate.

Another object of the present invention is to provide a T-Grid LED lighting system with insertedly coupled illumination assembly, including a T-Bar configured to be incorporated into a T-Grid ceiling system, an illumination assembly, including: a bottom plate; an LED lighting module insertedly coupled to the bottom plate; and a lens insertedly coupled to the bottom plate; wherein the LED lighting module is in thermal communication with the bottom plate and the T-Bar.

Another object of the present invention is to provide a method of mounting a T-Grid LED lighting system with insertedly coupled illumination assembly to a T-Grid ceiling, including: assembling the T-Grid LED lighting system, said T-Grid LED lighting system including a T-Bar and an illumination assembly; and incorporating a T-Bar into a T-Grid ceiling, said T-Bar including a keel and a horizontal bar wherein the keel and the horizontal bar are immovably coupled to each other at the cross-sectionally mid-point of the horizontal bar, forming a T-shaped structure and wherein the keel further including at least one through-holes.

For purpose of the above-mentioned objects and other benefits that can be derived therefrom, the present invention discloses a T-Grid LED lighting system that are easy to install, maintain and update, a system that provides solutions to eliminating unlit part of luminaries when combined end-to-end, and an electrical system that's wired in a manner to prolongs the life span and provides even light distribution of the LEDs.

BRIEF DESCRIPTION OF FIGURES

The above-mentioned advantages and other features of the present invention will become more apparent to and the invention will be better understood by people of ordinary skill of the art, with reference to the following description of the preferred embodiments of the invention taken in conjunction with the accompanying drawings, wherein.

DETAILED DESCRIPTION OF THE INVENTION

Figure 1:
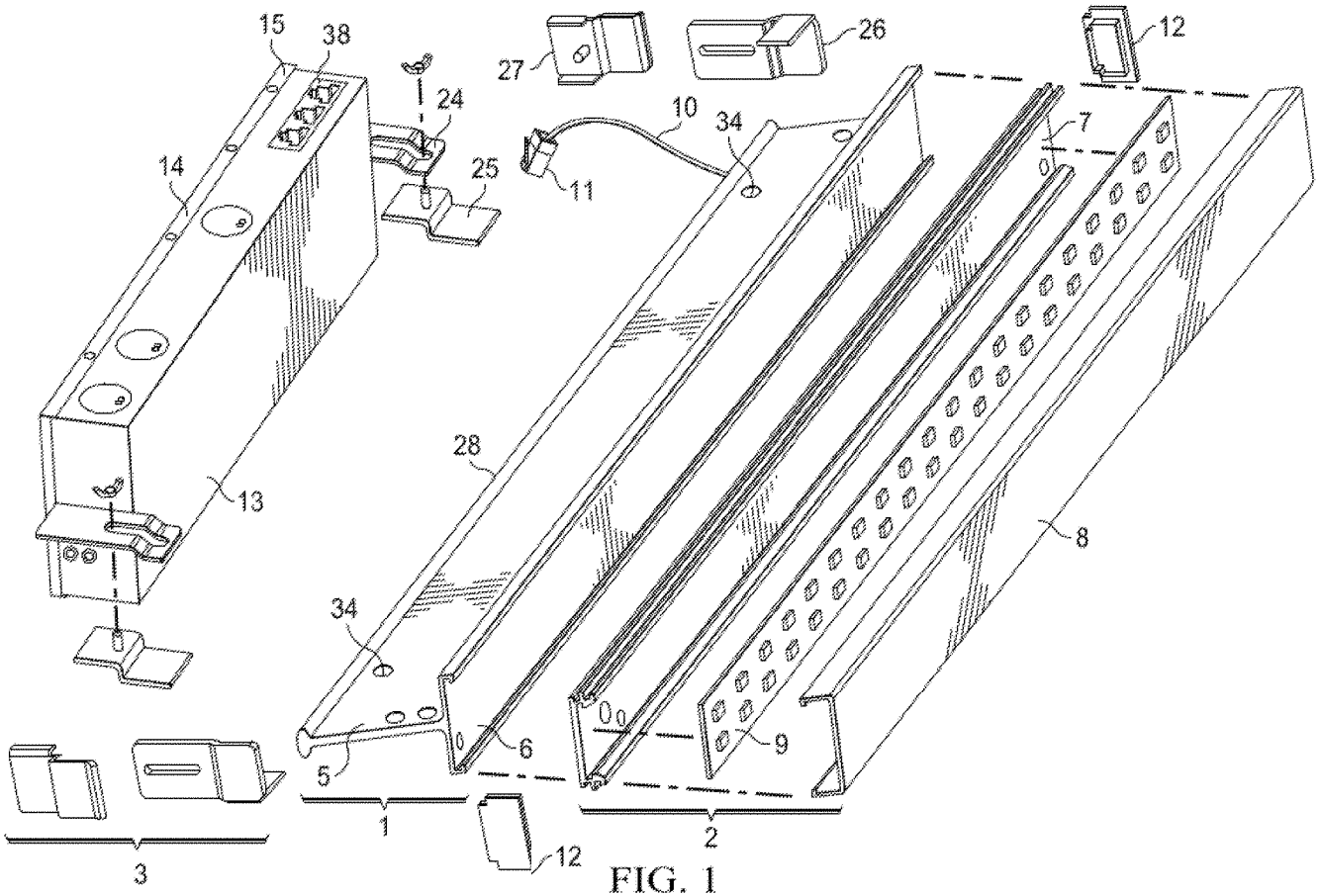
FIG. 1 is an exploded view of the T-Grid LED lighting system with insertedly coupled illumination assembly according to a preferred embodiment of the present invention.

One or more embodiments are illustrated by way of example, and not by limitation. In the figures of the accompanying drawings, elements having the same reference numeral designations represent like elements throughout. The drawings are not to scale, unless otherwise noted.

It is to be understood that all terminologies and phraseology used herein are for the purpose of illustrating and should not be understood as limiting. The phrases such as "including", "comprising", "having" and other variations thereof are meant to encompass the items as described and their equivalents without excluding any additional items thereof. Terms such as "coupled", "mounted", "connected" and other variations thereof are meant to be interpreted broadly to include any coupling, mounting and connection, directly or indirectly with or without intermediate items.

FIG. 1 is an exploded view of the T-Grid LED lighting system with insertedly coupled illumination assembly according to a preferred embodiment of the present invention.

Referring to FIG. 1, the T-Grid LED lighting system with insertedly coupled illumination assembly comprises a T-Bar 1, an illumination assembly 2, and a driver assembly 3. The T-Grid LED lighting system has a longitudinal direction or axis, along which the long sides of the T-Bar 1, the illumination assembly 2 and the driver assembly 3 extend.

Figure 2:
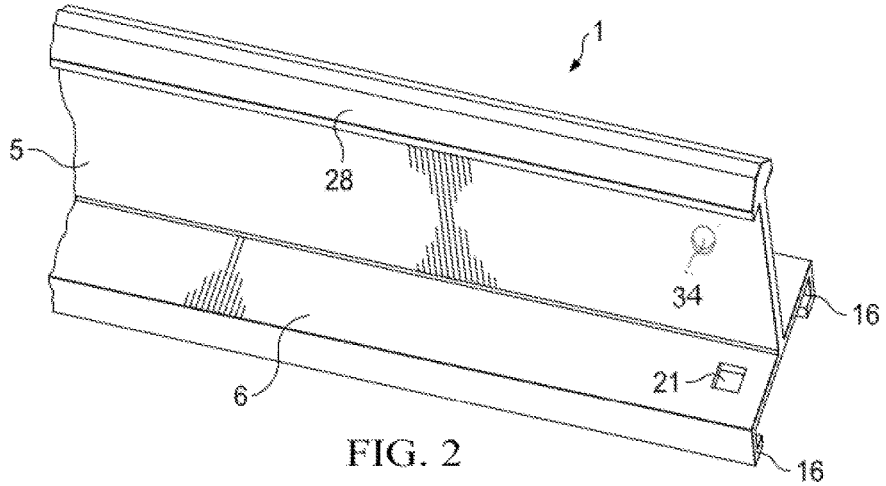
FIG. 2 is a close partial perspective view of one end of the T-Bar according to a preferred embodiment of the present invention.

FIG. 2 is a close partial perspective view of one end of the T-Bar 1. Referring to FIGS. 1 and 2, T-Bar 1 is a long and rigid structure comprising a keel 5 and a horizontal bar 6. The keel 5 and the horizontal bar 6 are immovably coupled at the cross-sectionally mid-point on a top surface of the horizontal bar 6 and extends along the longitudinal axis of the horizontal bar 6, forming a T-shaped structure based on which the T-Bar 1 is named. At the top of the keel 5, the ridge 28 with on the edge of keel 5 has a slightly enlarged width cross-sectionally. On the body of keel 5, two through-holes 34 are located therein, each near the ends of the keel 5. T-Bar 1 is preferably made of materials with good heating dissipation performance, such as aluminum. The tall vertical height of the keel 5 and the long length of the horizontal bar 6 provide plenty of heat dissipation spaces for heat generated by the illumination assembly 2. As will be further described elsewhere herein, combined with the advantage of using a very low voltage power compatible with RJ connectors, such as RJ45 connectors, the present invention provides an advantageous heat dissipation design that eliminates the need for dedicated or separated heat dissipation structures such as the fin structure disclosed in Porciatti, U.S. Pat. No. 8,177,385.

When T-Bar 1 is mounted to a T-Grid ceiling system, two neighboring ceiling tiles of the T-Grid ceiling rest on both sides of the keel 5 on the top surface of the horizontal bar 6. In other words, the T-Bar 1 is mounted between ceiling tile gaps, with the top side of the horizontal bar 6 on flush contact with the inner side of the ceiling tile visible within the room, and the keel 5 located through and above the ceiling tile gaps, with the top of keel 5 hidden from above ceiling tiles and not visible from the room. The through-holes 34 are used in conjunction with the structural ceiling of the building that incorporate the T-Grid ceiling system to hang or otherwise fix the T-Grid LED lighting in place. The ridge 28 provides mounting and/or fixing structure for the driver assembly 3 as further illustrated elsewhere herein.

Referring back to FIG. 1, the illumination assembly 2 comprises a bottom plate 7, an LED module 9 and an insertedly coupled illumination assembly 8. The bottom plate 7, the LED module 9 and the insertedly coupled illumination assembly 8 comprise matching grooves and tracks configured to be insertedly mounted onto each other and form the illumination assembly 2, which will be described in more detail elsewhere herein. The illumination assembly 2 further comprises at least two end covers 12 that can be insertedly mounted to illumination assembly 2 at each of the terminal ends thereof. The end covers 12 are configured to close off the open spaces formed on each end of the illumination assembly 2 after the bottom plate 7, the LED module 9 and the insertedly coupled illumination assembly 8 are mounted together.

Figure 3:
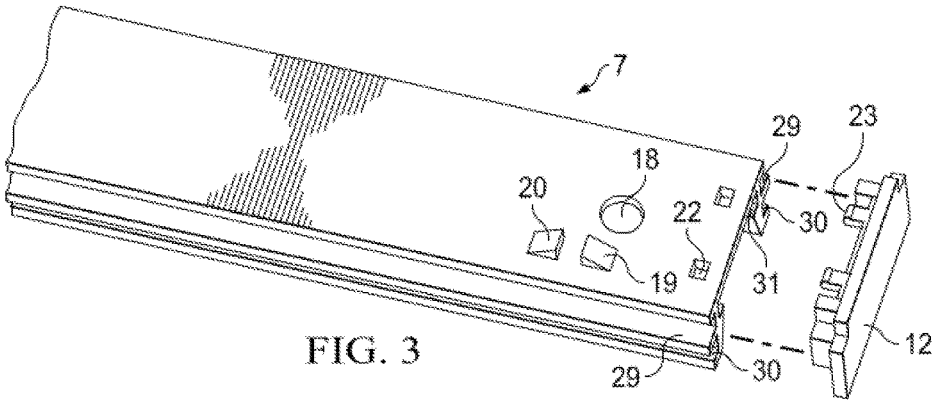
FIG. 3 is a close partial perspective view of one end of the bottom plate according to a preferred embodiment of the present invention.

In the T-Grid LED lighting system, the T-bar 1 and the illumination assembly 2 are connected to each other via the mounting of the horizontal bar 6 of T-bar 1 and the bottom plate 7 of the illumination assembly 2. FIG. 2 is a close partial perspective view of one end of the T-Bar 1, that was partially described above. FIG. 3 is a close partial perspective view of one end of the bottom plate 7. Now referring to FIGS. 1, 2 and 3, the horizontal bar 6 has an aperture 21 located near one terminal end of it, and to one side of the keel 5. The aperture 21 is configured to receive a fastener 20 on the bottom plate 7 to lock the bottom plate 7 in place.

On the bottom side of the horizontal bar 6, which is to the opposite side of where keel 5 is located, the edges on the longitudinal axis of the horizontal bar 6 extend down- and in-ward, forming two side tracks 16 on the horizontal bar 6. The space between the side tracks 16 and the bottom side of the horizontal bar 6 also provide the space for tracks on bottom plate 7 to go in and interlock the horizontal bar 6 together with the side tracks 16, which will be described in further detail elsewhere herein.

As illustrated in FIG. 3, bottom plate 7 comprises top, middle and bottom edges on the longitudinal axis thereof, whereas the top, middle and bottom edges are the edges in descending orders on the bottom plate 7 when the T-Grid LED lighting system is mounted to the ceiling. A plurality of slots, namely slots 29, 30 and 31 are formed between the edges of the bottom plate 7, providing the spaces for corresponding tracks from various parts to be insertedly received therein, interlocking the various parts of T-Bar 1 and the illumination assembly 2. In particular, slots 29 are located between the top and middle edges of the bottom plate 7. Slots 29 are configured to insertedly receive the side tracks 16 of the horizontal bar 6 on both sides respectively, thereby locking T-Bar 1 and the bottom plate 7 together.

Referring to FIGS. 2 and 3, on one end of the longitudinal side of the bottom plate 7, a fastener 20 of a slope shape is located therein, comprising a higher end and a lower end. Another slope shaped stopper 19 is located near the fastener 20, which also comprises a higher and a lower end. The higher ends of the fastener 20 and stopper 19 face each other. The fastener 20 is configured to be received by the aperture 21 on the horizontal bar 6. When mounting the bottom plate 7 and horizontal bar 6 together, the side tracks 16 are first inserted into the slots 29 from the end opposite to where the fastener 20 is located and slide along the slot 29. When the bottom plate 7 and the horizontal bar 6 slide toward each other along the tracks 16 to where the fastener 20 and the aperture 21 are fully aligned, the fastener 20 will snap into the aperture 21, thereby stopping the sliding movement. On horizontal bar 6, the width between the aperture 21 and the near-side terminal end of the horizontal bar 6 is configured to closely fit into the gap between the fastener 20 and the stopper 19 on bottom plate 7. As the higher ends of the fastener 20 and stopper 19 face each other, when the part between the aperture 21 and the near-side terminal end of the horizontal bar 6 get between 20 and 19, said part will fall down to the gap between 20 and 19 are be locked therein. As such, the T-Bar 1 and the bottom plate 7 are securely mounted to each other.

An aperture 18 is located on the bottom plate 7 near the fastener 20 and the stopper 19 to allow electrical wiring of the illumination assembly 2 to be routed therethrough. Two apertures 22 are also located parallel to the terminal end of the bottom plate 7, wherein end covers 12 having corresponding fasteners receivable by the apertures 22 can be installed therein by snapping into the apertures 22 and effectively close off the open spaces on the terminal ends of the illumination assembly 2.

Figure 4:
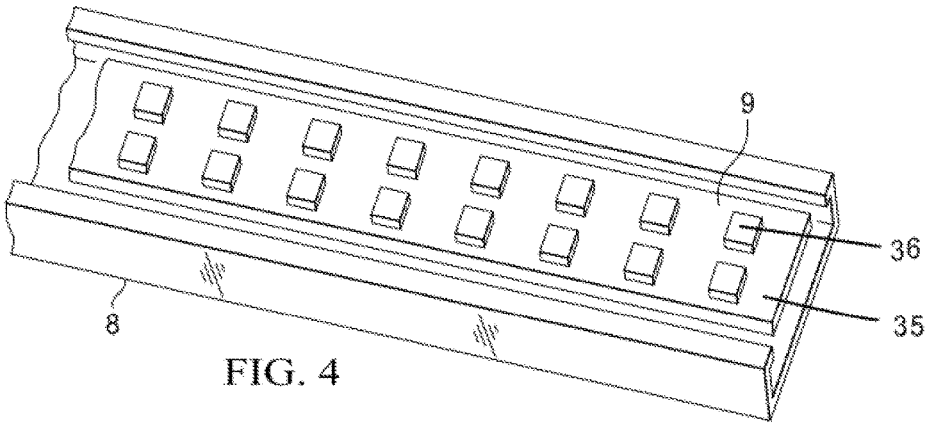
FIG. 4 is a close partial perspective view of one end of the LED module and the insertedly coupled illumination assembly according to a preferred embodiment of the present invention.

The T-Grid LED lighting system achieves its replaceability of its lens and other parts by insertedly attach the LED module 9 and the lens 8 to the bottom plate 7, thereby providing convenience for servicing the LED module 9, changing colors of the lens 8 and achieving other goals brought by the replaceability of the various parts. FIG. 4 is a close partial perspective view of one end of the LED module 9 and lens 8.

Referring to FIGS. 3 and 4, the slots 31 formed between the bottom side of the bottom plate 7 and the inside edge of the bottom plate 7 are configured to insertedly receive the LED module 9. The LED module 9 comprises a board 35 and a plurality of LED lighting beads 36. The board 35 has a long and linear shape, with a uniform thickness, that can be insertedly received in the slot 31. It can be appreciated by people of ordinary skill of the art, that the LED module 9 can be conveniently serviced or replaced simply pulling it out from the slots 31.

Board 35 provides electricity to the plurality of LED lighting beads 36 it receives from the electrical wiring. The plurality of LED lighting beads 36 are located on and electrically communicative with board 35, emitting lights for illumination. The LED lighting beads 36 are evenly distributed across the board 35, thereby reducing heat concentration on the board 35. Board 35 is in thermal communication with the bottom plate 7, which is also preferably made of material with good heat dissipation performance, such as aluminum. As can be appreciated, T-Bar 1 is in thermal communication with the bottom plate. As such, the heat generated by the LED lighting beads and other electrical parts is effectively dissipated through the thermal communications among the aforementioned parts.

Referring back to FIGS. 3 and 4, the slots 30 located between the middle edge and the bottom edge of the bottom plate 7 are configured to insertedly receive the insertedly coupled illumination assembly 8. The edges of the insertedly coupled illumination assembly 8 are configured to be insertedly received by the slots 30, preferably after the LED module 9 is first inserted into the slots 31. It can be appreciated by people of ordinary skill of the art that the lens 8 can be replaced with any lens that with edges that can be inserted received by the slots 30. The lens can be diffusive lens or cover with various shapes and colors, thereby conveniently changing the visual effect of each of the lighting or of a design comprising a plurality of said lightings. Preferably, the insertedly coupled illumination assembly 8 is a diffusive cover that provides a glowing effect when the LEDs are lit.

End covers 12 are used to close off the open spaces on the terminal ends of the illumination assembly 2. End cover 12 comprises two fasteners 23 that are configured to be received by the apertures 22 on bottom plate 7 by snapping into said apertures. The end covers 12 are preferably made of the same color and material of the insertedly coupled illumination assembly 8 that allow light to go through and with the same color, thereby creating a continuous and uninterrupted lighting effect of the illumination assembly 2.

Figure 5:
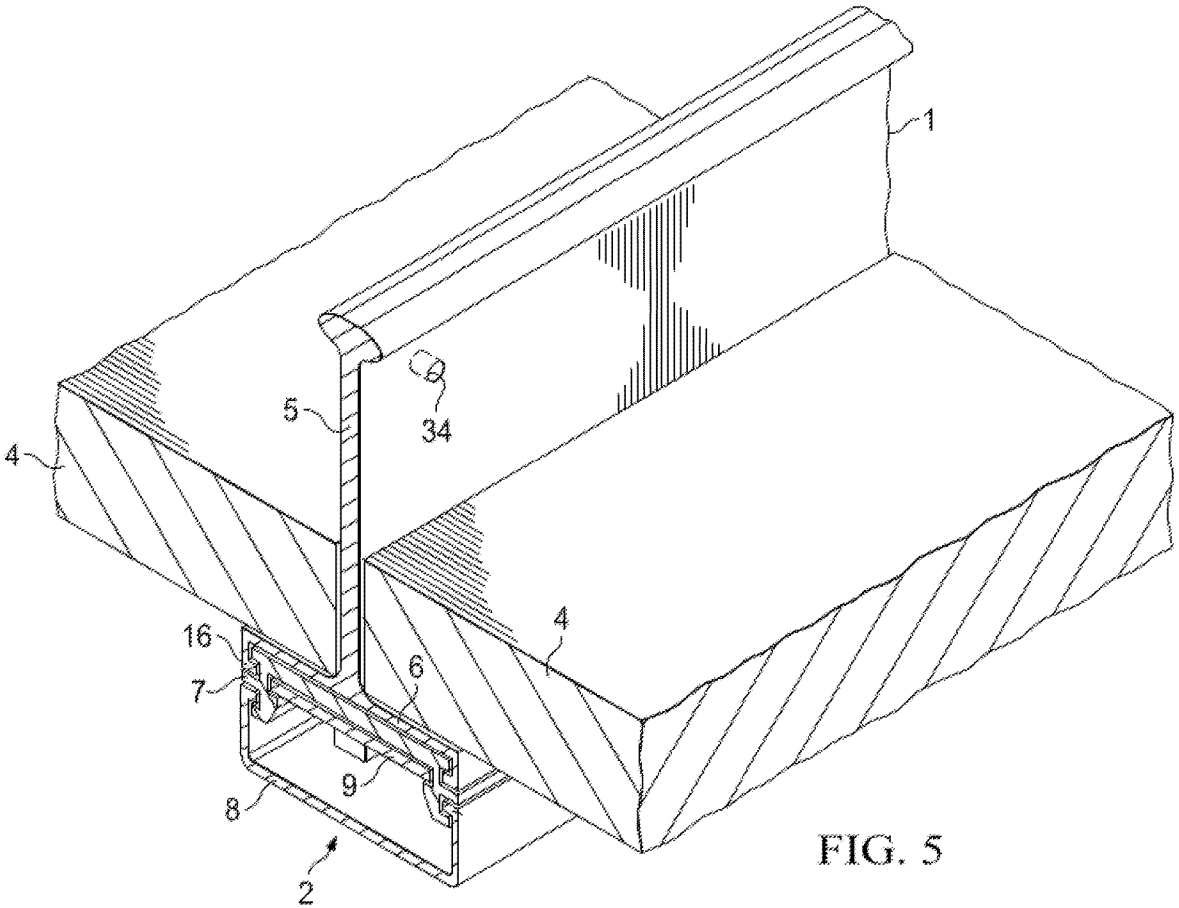
FIG. 5 is a perspective view of the T-Grid LED lighting system with insertedly coupled illumination assembly mounted on the T-Grid ceiling according to an embodiment of the present invention.
Figure 6:
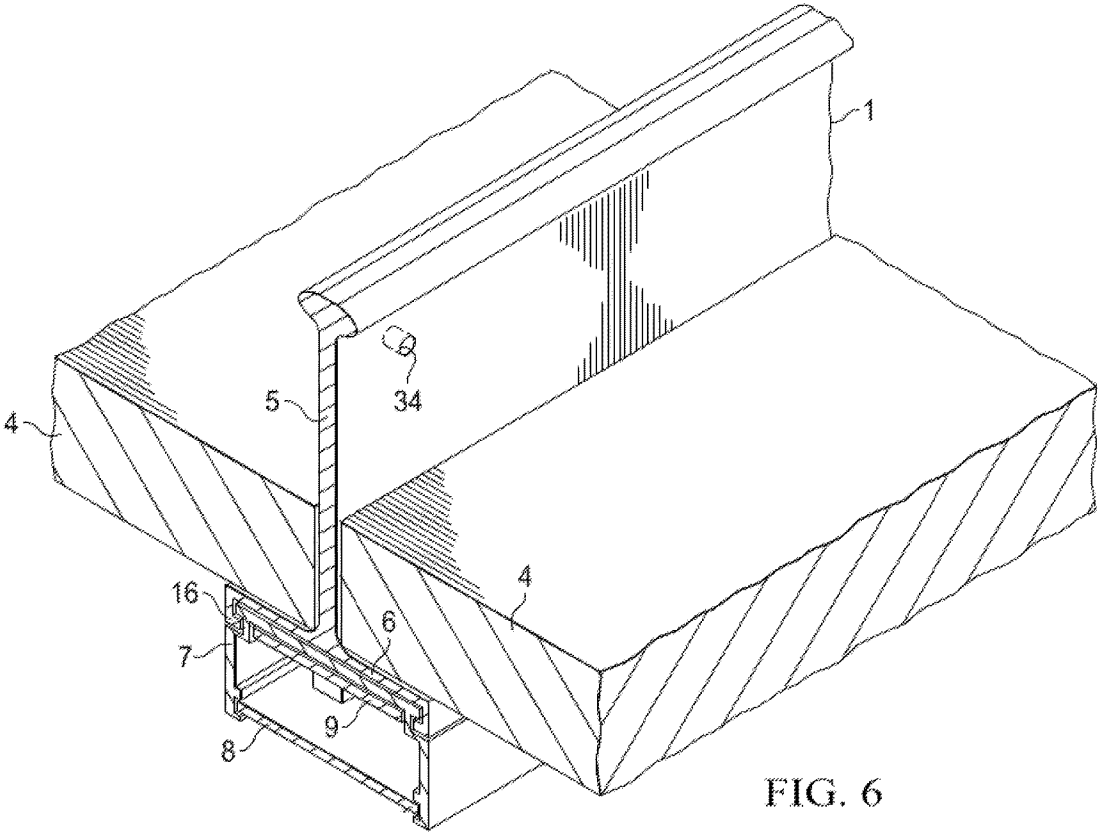
FIG. 6 is a perspective view of the T-Grid LED lighting system with insertedly coupled illumination assembly mounted on the T-Grid ceiling according to another embodiment of the present invention.

FIG. 5 is a perspective view of the T-Grid LED lighting system with insertedly coupled illumination assembly mounted on the T-Grid ceiling according to an embodiment of the present invention. FIG. 6 is a perspective view of the T-Grid LED lighting system mounted on the suspended ceiling according to another embodiment of the present invention. Now referring to FIGS. 5 and 6, T-Bar 1 is placed between two neighboring ceiling tiles 4 of the suspended ceiling of the T-Grid ceiling system. Horizontal bar 6 of the T-Bar 1 is in flush contact with the bottom side of the ceiling tiles 4. Keel 5 extends upward between the gap of ceiling tiles 4 and is not visible to the people in the room. On ridge 28, driver assembly 3 can be mounted therein (not shown). FIG. 5 further illustrates the assembly of the illumination assembly 2 as described in connection with FIGS. 1-4. When illumination assembly 2 is lit, light will come through the insertedly coupled illumination assembly 8 and end covers 12, providing a glowing effect throughout the visible part of the luminaire.

Comparing FIG. 6 to FIG. 5, it can be appreciated that FIG. 6 is an alternative embodiment of the present invention. Referring to FIG. 6, the length sides of the bottom plate 7 extends downwards, whereas the insertedly coupled illumination assembly 8 is in a shape of plate that can be insertedly coupled into the slots at the bottom of the extended bottom plate 7. As such, the overall look of the illumination assembly 2 of this embodiment is substantially the same as the embodiment of FIG. 5. However, depending on the choice of material of bottom plate 7, FIG. 6 may achieve a different lighting effect from FIG. 5. It can be appreciated by people of ordinary skill of the art that other alternatives of the present invention can be achieved by changing the slot arrangements, shapes and materials of the bottom plate 7, insertedly coupled illumination assembly 8 and the end covers 12.

Now referring back to FIG. 1, the driver assembly 3 comprises a junction box 13 and a plurality of mounting brackets 24, 25, 26 and 27. The junction box 13 comprises a driver housing 14 and a wire connection housing 15. A plurality of Registered Jacket (RJ) terminals 38 are located on one external side of the wire connection housing 15. Any one of the plurality of the RJ terminals 38 may receive an RJ connector 11 that is electrically communicative with the illumination assembly 2. According to a preferred embodiment of the present invention, the RJ terminals are RJ45 female terminals and the RJ connector 11 are RJ45 male connectors. It is well-known in the art that RJ connectors provide safe, low-voltage and smart power to electrical units they drive. The device and circuitry in the wire connection housing 15 (not shown) connect the power supply of the building and transform it into a suitable form of energy that powers up the RJ terminals 3. The T-Grid LED lighting system further comprises mounting brackets 24, 25, 26 and 27 that will be described in detail in connection with FIG. 7 herein.

Figure 7:
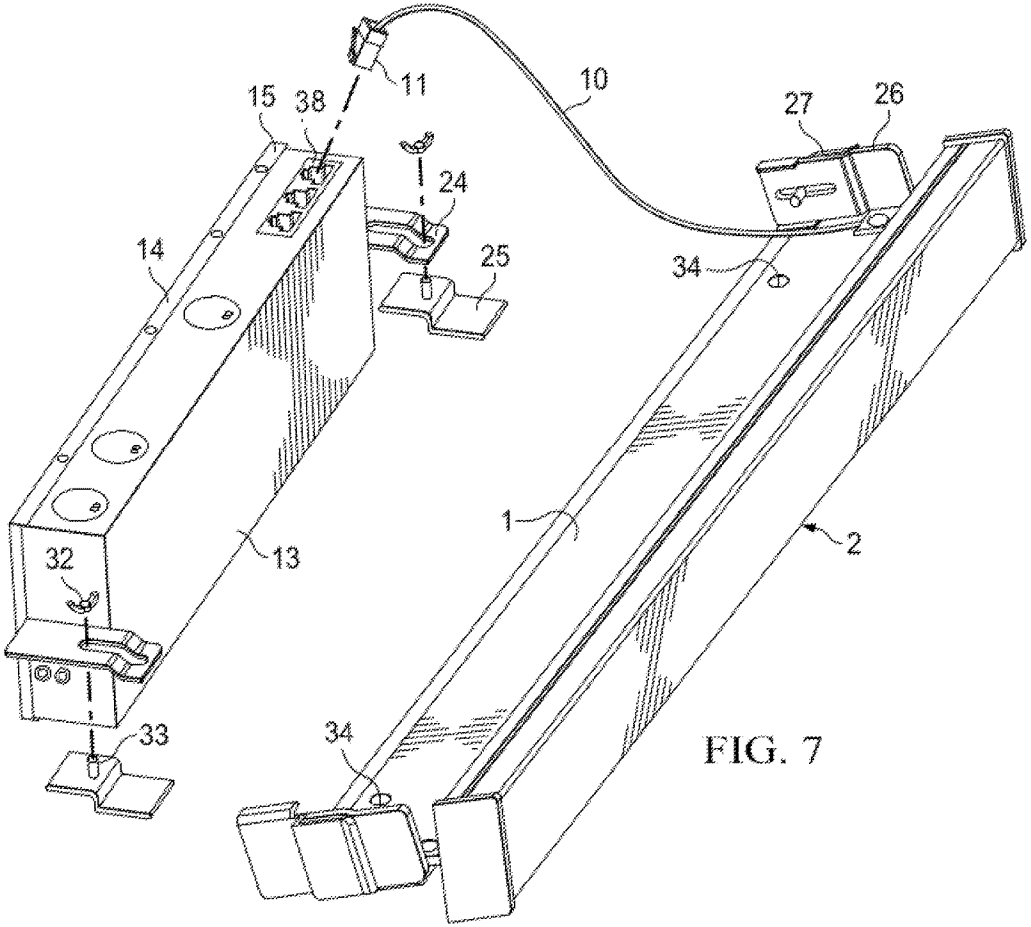
FIG. 7 is a perspective view of the T-Grid LED lighting system with detailed illustration of the driver assembly according to another embodiment of the present invention.

FIG. 7 is a perspective view of the T-Grid LED lighting system with detailed illustration of the driver assembly. Now referring to FIG. 7, the junction box 13 comprises a driver housing 14 and a wire connection housing 15. The driver housing 14 contains well-known driver unit (not shown) that connects and transforms the power supply of the building to provide a suitable power to the circuitry of the lighting system. The wire connection housing 15 contains electrical circuitry that receives power from the driver unit and transforms the power via a PCB board that supplies suitable power to multiple RJ connectors 11. On one side of the junction box 13, multiple RJ terminals 38 are located therein to provide electrical connection to the connector 11. The connector 11 is electrically communicative to the LED module 9 of the luminaire through a fireproof electrical wiring 10. As the power supplied to the connector 11 to drive the LED is a low voltage power, it eliminates the need of encapsulating the electrical wiring 10 in metal boxes to satisfy safety standards as in the prior art. As such it lowers the cost of installation and subsequent maintenance for users who adopt the T-Grid lighting system of the present invention.

Ridge 28 is formed on the top tip of the keel 5. Ridge 28 is configured to have a cross-sectional width larger than that of the keel 5 for the junction box 13 to be clamped thereon using the first mounting brackets 24 and the second mounting brackets 25. More specifically, the first mounting brackets 24 are immovably attached to the width side of the junction box 13. The second mounting brackets 25 are fastened onto the first mounting brackets 24 by extending shafts 33 configured to receive fasteners 32 through the apertures on the first mounting brackets 25, said shafts 33 protruding from the second mounting bracket 25. The brackets 24 and 25 have bends on them, said bends are configured in such a way that when brackets 24 and 25 are fastened, the brackets will securely clamp onto the ridge 28.

Similarly, third mounting brackets 27 are immovably attached on the terminal ends of T-Bar 1*c*. fourth mounting brackets 26 are fastened onto the third mounting brackets 27 by extending shafts configured to receive fasteners through the apertures on the third mounting brackets 27, said shafts protruding from the fourth mounting bracket 26. The brackets 26 and 27 have bends on them, said bends are configured in such a way that when brackets 26 and 27 are fastened, the brackets may securely clamp onto rigid edges such as the ridge 28 or other edges the T-Grid ceiling system may provide.

In light of the detailed description of the present invention in connection with the accompanying figures above, it is apparent to the people of ordinary skill that present invention has the following advantages in addition to the other advantages mentioned above:

First, the three main parts of the illumination assembly 2, namely the bottom plate 7, the LED module 9 and insertedly coupled illumination assembly 8, are all insertedly coupled to the each other or T-Bar 1. Comparing to the present technology whose illumination parts are substantially immovably attached to each other, it can be appreciated that this design greatly increases the flexibility and convenience in maintaining, replacing and upgrading the lightings and its visual effects in a highly efficient and cost-saving ways.

Second, one driver assembly can provide power to drive multiple lightings of the present invention via the plurality of the RJ jacket terminals. It saves costs, reduces the weight of the lighting system and reduces the complexity of the wirings.

Third, the lightings are driven by very low voltage power that's compatible with the RJ jacket powers. Therefore, it eliminates the need of using fireproof electrical wirings that are highly expensive. It also eliminates the need to encapsulating the wirings into metal conduit tubes that are not only expensive but also add a lot of weight to the system. And more importantly, it can be appreciated by people of the ordinary skill of the art that the low voltage power will also reduce the total heat the LED module may produce.

Further, the present invention provides a flush mount of the lightings to the ceiling tiles. As such, the visual gaps between the lights and the ceiling tiles are eliminated. Also, the end covers of the lightings may match the insertedly coupled illumination assembly 8. Therefore, when several lightings are combined, they can be arranged in a way that there appears to be no visual gaps between them. Given that the LED module may be created in an extremely linear shape by having very narrow width, the lightings of the present invention can create singularly or in combination a simple, low-profile, modern and flowing visual effect.

It is to be understood that the above description is intended to be illustrative and not restrictive. Many embodiments and applications other than the examples provided herein would be apparent upon reading the above description. The scope should be determined, not with reference to the above description, but with reference to the appended claims, along with the full scope of equivalents to which such claims are entitled. It is anticipated and intended that future developments will occur in the technologies discussed herein, and that the disclosed systems and methods will be incorporated into such future embodiments. That is, it should be understood that the application is capable of modification and variation.

What is claimed is:

1. A T-Grid LED lighting system with insertedly coupled illumination assembly, comprising:

a T-Bar configured to be incorporated into a T-Grid ceiling system;

the illumination assembly, comprising:

a bottom plate;

an LED lighting module insertedly coupled to the bottom plate; and a lens insertedly coupled to the bottom plate;

wherein the illumination assembly is insertedly coupled to the T-Bar via the bottom plate.

2. The T-Grid LED lighting system of claim 1, wherein the illumination assembly further comprises at least one end cover, said at least one end cover is configured to close off a space on at least one terminal end of the illumination assembly.

3. The T-Grid LED lighting system of claim 1, wherein the illumination assembly is driven by low voltage power.

4. The T-Grid LED lighting system of claim 1, further comprising:

a driver assembly, wherein the driver assembly provides low voltage power to the LED lighting module.

5. The T-Grid LED lighting system of claim 4, wherein the driver assembly is configured to be mounted on top of the T-Bar.

6. The T-Grid LED lighting system of claim 4, wherein the driver assembly further comprising:

a driver housing comprising an LED driver module; and a circuitry housing comprising at least one registered jacket terminal, wherein said at least one registered jacket terminal is configured to provide low voltage power to the LED lighting module.

7. The T-Grid LED lighting system of claim 1, wherein the T-Bar further comprises:

a keel; and a horizontal bar, wherein the keel and the horizontal bar are immovably coupled to each other at the cross-sectionally mid-point of the horizontal bar, forming a T-shaped structure.

8. The T-Grid LED lighting system of claim 1, wherein at least one of the T-Bar and the bottom cover is made of aluminum.

9. A T-Grid LED lighting system with insertedly coupled illumination assembly, comprising:

a T-Bar configured to be incorporated into a T-Grid ceiling system, the illumination assembly, comprising:

a bottom plate;

an LED lighting module insertedly coupled to the bottom plate; and a lens insertedly coupled to the bottom plate;

wherein the LED lighting module is in thermal communication with the bottom plate and the T-Bar.

10. The T-Grid LED lighting system of claim 9, wherein the T-Bar further comprising:

a keel; and a horizontal bar, wherein the keel has an extended vertical height facilitating the thermal communication of the LED lighting module.

11. The T-Grid LED lighting system of claim 9, wherein the illumination assembly is driven by low voltage power.

12. The T-Grid LED lighting system of claim 9, wherein the LED lighting module further comprising:

a plurality of LED beads; and a board providing power to the plurality of LED beads, wherein the plurality of LED beads are substantially evenly distributed across the board thereby reducing heat concentration.

13. The T-Grid LED lighting system of claim 9, further comprising:

a driver assembly, wherein the driver assembly provides low voltage power to the LED lighting module thereby reducing heat generation.

14. The T-Grid LED lighting system of claim 13, wherein the driver assembly is configured to be mounted on top of the T-Bar, thereby reducing heat concentration near the illumination assembly.

15. The T-Grid LED lighting system of claim 9, wherein at least one of the T-Bar and the bottom cover is made of aluminum.

16. A method of mounting a T-Grid LED lighting system with insertedly coupled illumination assembly to a T-Grid ceiling, comprising:

assembling the T-Grid LED lighting system, said T-Grid LED lighting system comprising a T-Bar and the illumination assembly, wherein the assembling the T-Brid LED lighting system comprising:

insertedly coupling a bottom plate to the T-Bar;

insertedly coupling an LED lighting module to the bottom plate; and insertedly coupling a lens to the bottom plate; and incorporating a T-Bar into a T-Grid ceiling, said T-Bar comprising a keel and a horizontal bar wherein the keel and the horizontal bar are immovably coupled to each other at a cross-sectionally mid-point of the horizontal bar, forming a T-shaped structure and wherein the keel further comprising at least one through-holes.

17. The method of claim 16, wherein the incorporating comprising:

placing at least two neighboring ceiling tiles of the T-Grid ceiling on top of the horizontal bar, wherein the horizontal bar is in flush contact with the ceiling tiles;

placing the keel between and thorough the at least two neighboring ceiling tiles; and suspending the T-Grid LED lighting system to a structural ceiling.

18. The method of claim 16, wherein the assembling the T-Grid LED lighting system further comprising:

mounting a driver assembly on top of the T-Bar.

19. The method of claim 16, wherein the assembling the T-Grid LED lighting system further comprising:

electrically connecting low voltage power to the LED lighting module via registered jacket terminal connections.

* * * * *